United States Patent [19]

Vetterli

[11] Patent Number: 4,890,665

[45] Date of Patent: Jan. 2, 1990

[54] PROCESS FOR MAINTAINING OPEN A THROTTLED DISCHARGE PASSAGE OF A SLIDING CLOSURE UNIT DURING CONTINUOUS CASTING

[75] Inventor: Walter Vetterli, Winterthur, Switzerland

[73] Assignee: Metacon AG, Zurich, Switzerland

[21] Appl. No.: 281,053

[22] Filed: Dec. 8, 1988

[30] Foreign Application Priority Data

Dec. 12, 1987 [DE] Fed. Rep. of Germany ..... 3742215

[51] Int. Cl.[4] ..... B22D 11/18

[52] U.S. Cl. ..... 164/453; 164/488; 164/136; 222/590

[58] Field of Search ..... 164/453, 449, 450, 437, 164/488, 337, 133, 136; 222/590, 600

[56] References Cited

U.S. PATENT DOCUMENTS

| | | | |
|---|---|---|---|
| 4,583,717 | 4/1986 | Hasegawa et al. | 222/44 |
| 4,708,193 | 11/1987 | Tinnes | 164/453 |
| 4,730,660 | 3/1988 | Tinnes et al. | 164/453 |
| 4,759,479 | 7/1988 | Tinnes | 222/600 |
| 4,770,230 | 9/1988 | Tinnes et al. | 164/483 |

FOREIGN PATENT DOCUMENTS

| | | | |
|---|---|---|---|
| 61-212460 | 9/1986 | Japan | 164/453 |

*Primary Examiner*—Richard K. Seidel

*Attorney, Agent, or Firm*—Wenderoth, Lind & Ponack

[57] ABSTRACT

Molten metal is discharged from a metallurgical vessel through a discharge passage of a sliding closure unit into a continuous casting mold. The molten metal level in the mold is established within a predetermined range by throttling the passage by a sliding plate of the sliding closure unit, during which throttling operation deposits gradually form in the sliding closure unit to restrict the size of the throttle passage and thereby reduce the molten metal level. The molten metal level is maintained within the predetermined range by the controlled opening movement of the sliding plate to compensate for restriction of the throttle passage by the formation of the deposits. Such deposits periodically are removed from the sliding closure unit by, in a single and continuous operation, moving the sliding plate from a compensating throttling position to which the sliding plate previously has been moved due to the formation of deposits, through an open unthrottled position of the sliding plate during which a surge of molten metal through the discharge passage flushes away the deposits, to a throttling position necessary to maintain the molten metal level within the predetermined range without the presence of deposits. The speed of this moving operation is controlled to ensure that the molten metal level remains within the predetermined range.

9 Claims, 1 Drawing Sheet

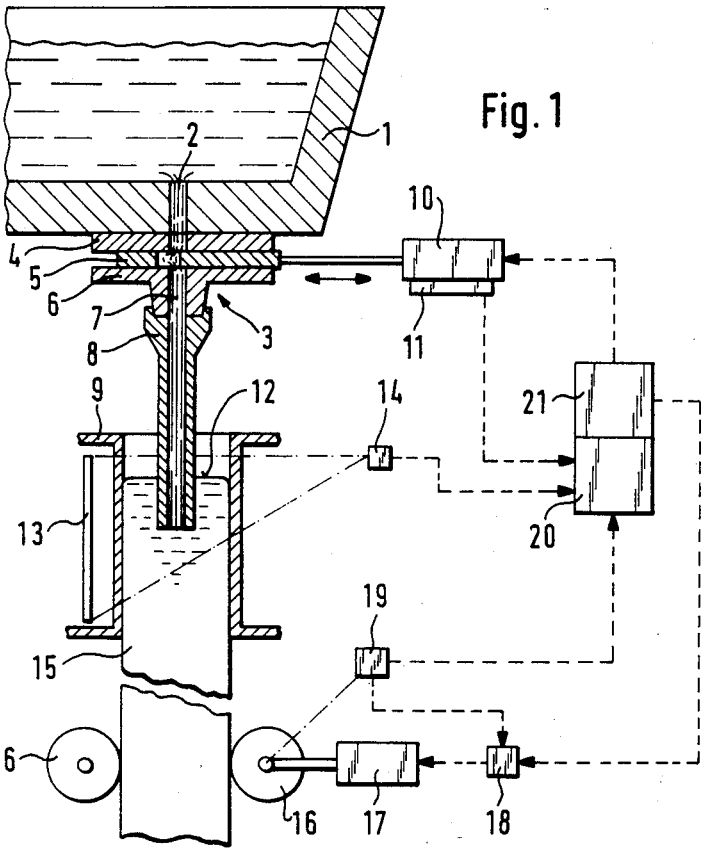
Fig. 1
Fig. 2
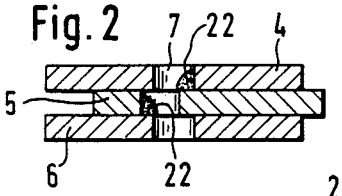
Fig. 3
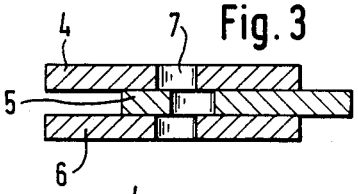
Fig. 4
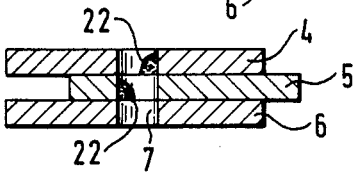

PROCESS FOR MAINTAINING OPEN A THROTTLED DISCHARGE PASSAGE OF A SLIDING CLOSURE UNIT DURING CONTINUOUS CASTING

BACKGROUND OF THE INVENTION

The present invention relates to a process for maintaining open a throttled discharge passage of a sliding closure unit during continuous casting of a molten metal from a metallurgical vessel, such as an intermediate vessel or tundish, through the sliding closure unit to a mold of a continuous casting apparatus. More specifically, the present invention is directed to an improved process for discharging molten metal from a metallurgical vessel through a discharge passage of a sliding closure unit into a continuous casting mold, establishing the molten metal level in the mold within a predetermined range by throttling the passage by a sliding plate of the sliding closure unit, during which throttling operation deposits gradually form in the sliding closure unit to restrict the size of the throttle passage and thereby reduce the molten metal level, and maintaining the molten metal level within the predetermined range by the controlled opening movement of the sliding plate to compensate for restriction of the throttle passage by the formation of such deposits.

U.S. Pat. No. 4,708,193 discloses a process for removing such deposits from the sliding closure unit and to maintain open the throttle discharge passage. This known process involves an initial movement of the sliding plate to close, or at least to restrict, the discharge passage for a substantial period of time to enable the molten metal level in the continuous casting mold to decrease by a substantial amount. The sliding plate then is moved to the completely open position to allow a surge of molten metal to flush away any deposits within the sliding closure unit. This surge of molten metal and deposits fills the space within the mold created by the reduced molten metal level therein.

The present inventor has determined that this decrease of the molten metal level in the continuous casting mold has substantial disadvantageous influences on the quality of the cast strand. It particularly has been determined that such differences in level cause surface defects in the cast strand. The use of this known process, accordingly, discourages the use of such operation at frequent time intervals, such that the process is employed at relatively large time intervals. This in turn tends to reduce the effectiveness of removing deposits from the sliding closure unit, and this itself has a disadvantageous effect on quality of the cast strand.

SUMMARY OF THE INVENTION

Accordingly, it is an object of the present invention to provide a process for maintaining open a throttled discharge passage of a sliding closure unit during a continuous casting operation by the removal of deposits formed in the sliding closure unit while avoiding the necessity of drastic level changes of the molten metal within the continuous casting mold, and thereby avoiding the resultant disadvantageous influence on the quality of the cast strand.

The above and other objects of the present invention are achieved by removing deposits from the sliding closure unit by, in a single and continuous operation, moving the sliding plate from a compensating throttling position to which the sliding plate has been moved previously due to the formation of the deposits, through an open unthrottled position of the sliding plate during which a surge of molten metal through the discharge passage flushes away the deposits, to a throttling position necessary to maintain the molten metal level within a predetermined range without the presence of deposits. The speed of the single and continuous and moving operation of the sliding plate is controlled to ensure that the molten metal level remains within the predetermined range, and specifically to ensure that the molten metal level is not reduced to such an extent to have a deleterious effect on the quality of the cast strand, and to ensure that the level is not increased by an amount to deleteriously influence the quality of the cast strand or to overflow from the mold. It particularly is achieved in accordance with the present invention that overflowing of the molten metal from the mold is avoided without the necessity of reducing the molten metal level.

In accordance with the process of the present invention, it is possible to maintain the desired level control of the molten metal within the mold while at the sae time effectively flushing deposits from the sliding closure unit. As a result, the molten metal level within the mold fluctuates only within acceptable limits, and level variations of an extent to deleteriously effect the quality of the cast strand do not occur. Accordingly, the process of the present invention achieves the advantages of the known process while at the same time avoiding the disadvantages thereof.

In accordance with a particularly preferred embodiment of the present invention the single and continuous moving operation is uninterrupted and in a single direction, such that the throttling position to which the sliding plate is moved by the moving operation is a different throttling position employing different throttling surfaces of the sliding closure unit than the compensating throttling position from which the sliding plate was moved at the commencement of the moving operation. Particularly, the surfaces of the sliding closure unit operating to throttle the molten metal in the two throttling positions are at locations on opposite sides of the discharge passage. In other words, the sliding plate is moved from one throttling position to an opposed throttling position on an opposite side of the discharge passage. As a result of this preferred embodiment of the process of the present invention, in addition to the surge of molten metal through the discharge passage tending to flush away the deposits when the sliding plate is in the open unthrottled position, the deposits also are subjected to a deflection in the flow of the melt when the sliding plate is moved to the new, opposed throttling position. That is, when the sliding plate is moved to the new, opposed throttling position, the deflection of the molten metal flow is in a direction opposite to that previously achieved when the sliding plate was in the original throttling position. This reverse deflection flow of the molten metal operates to erode away any previously formed deposits remaining in the sliding closure unit. This feature of the present invention further provides the advantage that the deflected flows of molten metal operate on different surfaces of the sliding closure unit. As a result, erosion of the plates of the sliding closure unit, which inevitably occurs, tends to be more uniform over the various involved surfaces of the sliding closure unit. This results in an increased service life of the plates of the sliding closure unit. Thus, in accordance with this embodiment of the present invention the same quantity of molten metal flow can be achieved at different throttling positions of the sliding plate.

Coordination of the speed of the moving operation of the sliding plate with the control of the desired molten metal level within the mold is a function of two factors. Firstly, the surge or impulse of molten metal through the discharge passage to flush away the deposits when the sliding plate is in the open unthrottled position must be sufficient to wash or flush away the previously formed deposits. Secondly, the quantity of molten metal conveyed through the open unthrottled discharge passage must be controlled to insure that the molten metal level in the mold does not rise above the maximum level of the predetermined range of levels. One skilled in the art would understand, from the present disclosure, how to regulate these two factors with respect to a given continuous casting installation of given parameters and employing a particular molten metal.

In accordance with a further feature of the present invention, the single and continuous moving operation of the sliding plate can be initiated or commenced periodically at predetermined time intervals, for example regular time intervals. Such intervals would be determined, as would be understood by one skilled in the art from the present disclosure, depending upon the particular operating conditions in a particular continuous casting installation. Factors influencing such time intervals would be the particular molten metal being cast and its properties, particularly the tendency for the formation of deposits, as well as the dimensions, particularly the cross section, of the mold employed. Such time interval could range from one to ten minutes, depending on the cross section of the mold involved, when discharging conventional molten metals. This is not intended to be limiting however, and one skilled in the art would understand from the present disclosure how to determine a desired time interval for initiation of flushing movement of the sliding plate for a given operation. As an alternative, the initiation or commencement of the moving operation of the sliding plate can occur upon the sliding plate reaching a predetermined position as a result of the previously occurring controlled opening movement of the sliding plate to compensate for restriction of the throttled passage by the formation of the deposits. In other words, as the sliding plate gradually is opened to compensate for restriction of the throttled passage due to the formation of the deposits in the sliding closure unit, upon the sliding plate reaching a predetermined relatively opened position, the single and continuous movement of the sliding plate to achieve flushing of the deposits can be initiated. In this alternative, the commencement of the single and continuous moving operation is a function of the degree to which the throttle discharge passage has become restricted, i.e. the degree of deposit formation.

In accordance with a further feature of the present invention, it is possible to, at least prior to the initiation of the single and continuous moving operation, vibrate or oscillate the sliding plate to thereby inhibit the formation of the deposits and aid in the clearing thereof. The extent or length of any such oscillating or vibratory movement would be of very small dimension, to avoid disadvantageously effecting the throttling position of the sliding plate, as would be understood by one skilled in the art. In accordance with a yet further feature of the present invention it is possible, at least during the single and continuous sliding plate moving operation, to introduce a flushing gas into the discharge passage to thereby assist flushing away of the deposits. Particularly, such gas may be introduced into the inlet to the sliding closure unit or into the casting tube that extends from the sliding closure unit into the mold. Such gas introduction aids the molten metal surge to flush away deposits from the inlet spout and casting tube.

BRIEF DESCRIPTION OF THE DRAWINGS

Other objects, features and advantages of the present invention will be apparent from the following detailed description, taken with the accompanying drawings, wherein:

FIG. 1 is a schematic illustration of an apparatus employed in accordance with the present invention; and FIGS. 2–4 are enlarged schematic cross sectional views of the sliding closure unit employed in FIG. 1, but illustrating different positions of a sliding plate thereof during carrying out of the process of the present invention.

DETAILED DESCRIPTION OF THE INVENTION

In FIG. 1 is shown a metallurgical vessel 1, such as an intermediate vessel or tundish, containing molten metal that is discharged through a discharge opening 2 in the bottom of the vessel. The discharge of the molten metal is controlled by a sliding closure unit 3 including upper and lower fixed plates 4, 6 with a sliding plate 5 therebetween. These are refractory plates as is known in the art, and the relative movement of sliding plate 5 throttles a discharge passage 7 through the sliding closure unit. Attached to the outlet of the sliding closure unit is a casting tube 8 having a free end projecting into a continuous casting mold 9, specifically to be immersed below a desired upper level 12 of the molten metal therein. The sliding movement of plate 5 is controlled by a conventional positioner or correction device 10, and the operating position of device 10 is detected by a position measuring device or detector 11. The molten metal is discharged into mold 9 and solidifies therein as a cast strand 15 that is discharged outwardly by drive rollers 16 driven by a driver 17 controlled by speed controller 18. A velocity measuring device 19 transmits a velocity output signal to a processor 20, and device 19 also sends data to controller 18. The level of the molten metal in mold 9 is maintained at a desired level within a predetermined range controlled by a sender (ray emitter) 13 and a receiver 14. Processor 20 also receives and processes data from position measuring device 11 and receiver 14. Resulting control commands are sent by a controller or interface 21 integrated into processor 20 to correction device 10 controlling the movement of sliding plate 5 and to take off controller 18. The above features of the present invention are themselves intended to be conventional, such as disclosed in U.S. Pat. No. 4,708,193, the disclosure of which hereby is repeated and incorporated by reference.

The take off speed of the cast strand 15 generally is fixed as a constant, for quality reasons as would be understood by one skilled in the art. Therefore, the desired level 12 in mold 9 is controlled solely from the inflow side by means of the slide plate 5 controlling the size of the throttled discharge passage 7. Thus, sliding plate 5 is moved to more or less constrict the throttled discharge passage 7 to decrease or increase the amount of molten metal discharged into mold 9. Thereby, an equilibrium is established to ensure that the quantity of molten metal flowing into the mold per unit of time maintains the level 12 at the desired value, within a predetermined range.

When the sliding closure unit 3 is operated in this manner to throttle the discharge passage 7, the flow of molten metal is deflected twice, as shown with particular reference to FIGS. 1 and 2, at the inlet and outlet sides of the sliding plate 5. At these positions there is an increased risk of erosion of the refractory material of the plates of the sliding closure unit. As such erosion occurs, the size of the throttled discharge passage 7 increases, resulting in an increase of level 12. This is detected by elements 13, 14 and this results in elements 20, 21 and 10 moving sliding plate 5 to further restrict or throttle the discharge passage 7. In addition to the above phenomenon, at the inlet and outlet areas of the opening through plate 5 there gradually are formed deposits 22, for example of oxides and/or sulfides. Deposits 22 tend to decrease the size of the throttled discharge passage 7, and as a result the level 12 tends to lower. This is detected by elements 13, 14 and this results in elements 20, 21 and 10 moving sliding plate 5 in a manner to increase the size of the throttled discharge passage 7. This is a controlled opening movement of sliding plate 5 to compensate for restriction of the throttled passage 7 by the formation of deposits 22. Eventually these controlled opening movements of sliding plate 5 will result in the plate 5 being in a position with its opening substantially aligned with the openings in plates 4 and 5, and further opening movement will not increase the size of the throttled passage. As a result, it will not be possible to maintain level 12 within the predetermined range, and it becomes necessary to interrupt the continuous casting operation.

As a result, it is desirable to remove deposits 22 without interrupting the casting operation. This is achieved in U.S. Pat. No. 4,708,193 in the manner discussed above, but this known process requires a substantial reduction in level 12 as an integral part of deposit removal. This is disadvantageous to the quality of the cast strand 15.

In accordance with the present invention however, in a single continuous operation, the sliding plate 5 is moved from a compensating throttling position to which the sliding plate has been moved due to the formation of deposits, for example as shown in FIG. 2, through an open unthrottled position of the sliding plate 5 during which a surge of molten metal through the discharge passage flushes away the deposits (such as shown in FIG. 4) to a throttling position necessary to maintain the molten metal level within the predetermined range without the presence of deposits. In accordance with a preferred embodiment of the present invention, the single and continuous moving operation is uninterrupted and in a single direction, with the result that the new throttling position to which the sliding plate is moved by the moving operation is a different throttling position employing different throttling surfaces of the sliding closure unit than the compensating throttling position from which the sliding plate is moved at the commencement of the moving operation. In other words, in accordance with the preferred embodiment of the present invention, in a single and continuous movement the plate 5 is moved from an initial compensating throttling position shown in FIG. 2, through an open unthrottled position shown in FIG. 4, to a new throttling position shown in FIG. 3 wherein the throttling edges of the sliding closure unit employed are opposed to the sliding closure unit edges employed for throttling in the original throttling position.

The above specific preferred embodiment of the present invention has the additional advantage that when the plate 5 is in the position of FIG. 3 the directions of deflection of the molten metal stream through the sliding closure unit are opposite to the directions of deflection in the position of FIG. 2, thereby tending to erode away any deposits 22 remaining at the positions shown in FIGS. 2 and 4. Also, there is the advantage that erosion of the plates 4–6 by the molten metal flowing therethrough will be applied to different surfaces of the plates in the position of FIG. 3 than in the position of FIG. 2. This tends to make erosion of the refractory material uniform over the surfaces of the plates.

The speed of the single and continuous moving operation of sliding plate 5 is controlled to ensure that the molten metal level remains within the predetermined range of levels. The speed is balanced with the requirement that the surge of molten metal through the discharge opening be sufficient to flush away the deposits 22. One skilled in the art readily would be able to adjust these factors as necessary in a given installation of a given size and employing a particular molten metal. It particularly is contemplated that the control of the moving speed of the sliding plate 5 will be sufficient to prevent the molten metal level 12 from exceeding a maximum level within the predetermined range. Instead of moving the plate 5 from an initial throttling position to a new, opposed throttling position, as will be apparent from a comparison of FIGS. 2 and 3, it is possible in accordance with the present invention to move the plate from the initial throttling position shown in FIG. 2 to the fully open position shown in FIG. 4 and then to return the plate 5 in the opposite direction to substantially the original position, i.e. or at least a position in the same throttling direction that is necessary to maintain the molten metal level within the predetermined range without the presence of deposits.

In accordance with one feature of the present invention, the moving operation of plate 5 to flush away deposits 22 can be initiated periodically at predetermined time intervals. Alternatively, such moving operation can be commenced upon a determination that sliding plate 5 has reached a predetermined position as a result of the controlled opening movement thereof to compensate for restriction of the throttled passage by the formation of the deposits, i.e. when sliding plate 5 has reached a fixed maximum degree of opening. Such a position is indicative of a significant amount, i.e. a given or predetermined amount, of deposits 22 already being formed in the throttled flow channel 7.

In either case, it is possible, at least during the moving operation, to introduce a flushing gas into the discharge passage 7 to thereby assist in flushing away of the deposits. Thus, such a gas can be introduced into discharge opening 2 and/or into casting tube 8. Furthermore, or alternatively, it is possible, at least prior to the initiation of the moving operation, to vibrate or oscillate sliding plate 5 to thereby inhibit the formation of the deposits or to tend to erode away already formed deposits. Such vibration or oscillation is of a small amplitude to avoid interference with the desired throttling position of the sliding plate. Such vibration and oscillation also may be applied to the plate during the moving operation.

The above description is with regard to a three-plate sliding closure unit of the linearly movable type. It is intended however that the present invention equally is applicable to two-plate sliding closure units and/or to sliding closure units of the rotary and pivotable type. Also, the present invention is applicable to continuous casters with a combination of feed and take off control as well as to sliding closure units on casting ladles, with the throttling operation being controlled as a function of the liquid level in the vessel.

Although the present invention has been described and illustrated with respect to preferred features thereof, it is to be understood that various changes and modifications may be made to the specifically described and illustrated features without departing from the scope of the present invention.

I claim:

1. In a process for discharging molten metal from a metallurgical vessel through a discharge passage of a sliding closure unit into a continuous casting mold, establishing the molten metal level in said mold within a predetermined range by throttling said passage by a sliding plate of said sliding closure unit, during which throttling deposits gradually form in said sliding closure unit to restrict the size of said throttled passage and thereby reduce said molten metal level, and maintaining said molten metal level within said predetermined range by the controlled opening movement of said sliding plate to compensate for restriction of said throttled passage by the formation of said deposits, the improvement comprising removing said deposits from said sliding closure unit by:

in a single and continuous operation moving said sliding plate from a compensating throttling position to which said sliding plate had been moved due to the formation of said deposits, through an open unthrottled position of said sliding plate during which a surge of molten metal through said discharge passage flushes away said deposits, to a throttling position necessary to maintain said molten metal level within said predetermined range without the presence of deposits; and controlling the speed of said single and continuous moving operation of said sliding plate to ensure that said molten metal level remains within said predetermined range.

2. The improvement claimed in claim 1, comprising controlling said moving speed to prevent said molten metal level from exceeding a maximum level of said predetermined range.

3. The improvement claimed in claim 1, wherein said single and continuous moving operation is uninterrupted and in a single direction.

4. The improvement claimed in claim 3, wherein said throttling position to which said sliding plate is moved by said moving operation is a different throttling position employing different throttling surfaces of said sliding closure unit than said compensating throttling position from which said sliding plate was moved at the commencement of said moving operation.

5. The improvement claimed in claim 4, wherein the surfaces of said sliding closure unit operating to throttle the molten metal in said two throttling positions are at locations on opposite sides of said discharge passage.

6. The improvement claimed in claim 1, comprising initiating said moving operation periodically at predetermined time intervals.

7. The improvement claimed in claim 1, comprising initiating said moving operation upon said sliding plate reaching a predetermined position as a result of said controlled opening movement thereof to compensate for restriction of said throttled passage by the formation of said deposits.

8. The improvement claimed in claim 1, further comprising, at least prior to initiation of said moving operation, vibrating or oscillating said sliding plate to thereby inhibit the formation of said deposits.

9. The improvement claimed in claim 1, further comprising, at least during said moving operation, introducing gas into said discharge passage to thereby assist flushing away of said deposits.

* * * * *